US009745122B2

(12) United States Patent
Dogan

(10) Patent No.: US 9,745,122 B2
(45) Date of Patent: Aug. 29, 2017

(54) INGREDIENT CAPSULE FOR BEVERAGE PREPARATION

(71) Applicant: NESTEC S.A., Vevey (CH)

(72) Inventor: Nihan Dogan, La Croix-sur-Lutry (CH)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 14/399,656

(22) PCT Filed: May 1, 2013

(86) PCT No.: PCT/EP2013/059064
§ 371 (c)(1),
(2) Date: Nov. 7, 2014

(87) PCT Pub. No.: WO2013/167435
PCT Pub. Date: Nov. 14, 2013

(65) Prior Publication Data

US 2015/0125576 A1 May 7, 2015

(30) Foreign Application Priority Data

May 7, 2012 (CH) ..... 12166965

(51) Int. Cl.
*B65D 85/804* (2006.01)

(52) U.S. Cl.
CPC ..... *B65D 85/8043* (2013.01)

(58) Field of Classification Search
CPC ..... B65D 85/8043; B65D 85/804; B65D 85/8046; A47J 31/54; A47J 31/44; A47J 31/0657; A47J 31/24; A47G 19/14
USPC ..... 426/77, 78, 79, 80, 81, 82, 83, 84; 99/295
See application file for complete search history.

(56) References Cited

U.S. PATENT DOCUMENTS

2002/0015768 A1* 2/2002 Masek et al. ..... 426/115
2005/0056153 A1* 3/2005 Nottingham ..... A47J 31/0642 99/279
2006/0280841 A1* 12/2006 Cai ..... 426/77
(Continued)

FOREIGN PATENT DOCUMENTS

DE 202006013189 10/2006
EP 1579792 9/2005
(Continued)

*Primary Examiner* — Michele L Jacobson
*Assistant Examiner* — Ericson M Lachica
(74) *Attorney, Agent, or Firm* — K&L Gates LLP

(57) ABSTRACT

Capsule (9) for use in a beverage preparation machine (1), said capsule comprising side (10), bottom (12) and top (11) walls defining a closed chamber, said capsule further comprising a beverage dispensing wall able to open for releasing a beverage prepared from said ingredient and said fluid, said capsule comprising a separating wall (14) within the chamber that separates, in a leak-tight manner, an ingredient-containing compartment (15), and a fluid injection compartment (16), said separating wall (14) comprising a one-way valve (17) able to let fluid under pressure flow only from the injection compartment towards the ingredient-containing compartment, said valve being actuated in its open configuration by the injection element (22) of the machine, wherein the one-way valve is either: (i) a spring-mounted ball valve, or alternatively (ii) a flexible resilient O-ring valve mounted in a circular channel of the separating wall.

3 Claims, 5 Drawing Sheets

(56) References Cited

U.S. PATENT DOCUMENTS

| | | | | |
|---|---|---|---|---|
| 2008/0029541 | A1* | 2/2008 | Wallace | B01F 13/1055 222/129.3 |
| 2010/0043646 | A1* | 2/2010 | Suggi Liverani et al. | 99/295 |
| 2010/0129512 | A1* | 5/2010 | Accursi | 426/431 |
| 2010/0180775 | A1* | 7/2010 | Kollep et al. | 99/295 |
| 2011/0151075 | A1* | 6/2011 | Peterson | A47J 31/002 426/238 |
| 2015/0072053 | A1* | 3/2015 | Dogan et al. | 426/112 |

FOREIGN PATENT DOCUMENTS

| | | |
|---|---|---|
| WO | 0056629 | 9/2000 |
| WO | 2008132571 | 11/2008 |

* cited by examiner

INGREDIENT CAPSULE FOR BEVERAGE PREPARATION

CROSS REFERENCE TO RELATED APPLICATIONS

The present application is a National Stage of International Application No. PCT/EP2013/059064, filed on May 1, 2013, which claims priority to European Patent Application No. 12166965.9, filed May 7, 2012, the entire contents of which are being incorporated herein by reference.

FIELD OF THE INVENTION

The present invention concerns a capsule for use in a beverage preparation machine; more precisely it concerns a capsule having a anti-backflow feature.

BACKGROUND OF THE INVENTION

Beverage preparation machines are well known in the food science and consumer goods area. Such machines allow a consumer to prepare at home a given type of beverage, for instance a coffee-based beverage, e.g. an espresso or a brew-like coffee cup.

Today, most beverage preparation machines for in-home beverage preparation comprise a system made of a machine which can accommodate portioned ingredients for the preparation of the beverage. Such portions can be soft pods or pads, or sachets, but more and more systems use semi-rigid or rigid portions such as rigid pods or capsules. In the following, it will be considered that the beverage machine of the invention is a beverage preparation machine working with a rigid or semi-rigid capsule.

The machine comprises a receptacle for accommodating said capsule and a fluid injection system for injecting a fluid, preferably water, under pressure into said capsule. Water injected under pressure in the capsule, for the preparation of a coffee beverage according to the present invention, is preferably hot, that is to say at a temperature above 70° C. However, in some particular instances, it might also be at ambient temperature. The pressure inside the capsule chamber during extraction and/or dissolution of the capsule contents is typically about 1 to about 8 bar for dissolution products and about 2 to about 12 bar for extraction of roast and ground coffee. Such a preparation process differs a lot from the so-called "brewing" process of beverage preparation—particularly for tea and coffee, in that brewing involves a long time of infusion of the ingredient by a fluid (e.g. hot water), whereas the beverage preparation process allows a consumer to prepare a beverage, for instance coffee, within a few seconds.

The principle of extracting and/or dissolving the contents of a closed capsule under pressure is known and consists typically of confining the capsule in a receptacle of a machine, injecting a quantity of pressurized water into the capsule, generally after piercing a face of the capsule with a piercing injection element such as a fluid injection needle mounted on the machine, so as to create a pressurized environment inside the capsule either to extract the substance or dissolve it, and then release the extracted substance or the dissolved substance through the capsule. Capsules allowing the application of this principle have already been described for example in applicant's European patent n° EP 1 472 156 B1, and in EP 1 784 344 B1.

Machines allowing the application of this principle have already been described for example in patents CH 605 293 and EP 242 556. According to these documents, the machine comprises a receptacle for the capsule and a perforation and injection element made in the form of a hollow needle comprising in its distal region one or more liquid injection orifices. The needle has a dual function in that it opens the top portion of the capsule on the one hand, and that it forms the water inlet channel into the capsule on the other hand.

The machine further comprises a fluid tank—in most cases this fluid is water—for storing the fluid that is used to dissolve and/or infuse and/or extract under pressure the ingredient(s) contained in the capsule. The machine comprises a heating element such as a boiler or a heat exchanger, which is able to warm up the water used therein to working temperatures (classically temperatures up to 80-90° C.). Finally, the machine comprises a pump element for circulating the water from the tank to the capsule, optionally though the heating element. The way the water circulates within the machine is e.g. selected via a selecting valve means, such as for instance a peristaltic valve of the type described in applicant's European patent application EP 2162653 A1.

When the beverage to be prepared is coffee, one interesting way to prepare the coffee is to provide the consumer with a capsule containing roast and ground coffee powder, which is to be extracted with hot water injected therein.

Capsules have been developed for such an application, which are described and claimed in applicant's European patent EP 1 784 344 B1, or in European patent application EP 2 062 831.

In short, such capsules comprise typically:

- a hollow body and an injection wall which is impermeable to liquids and to air and which is attached to the body and adapted to be punctured by e.g. an injection needle of the machine,
- a chamber containing a bed of roast and ground coffee to be extracted,
- an aluminum membrane disposed at the bottom end of the capsule, closing the capsule, for retaining the internal pressure in the chamber, the membrane being associated with piercing means for piercing dispensing holes in the aluminum membrane when the internal pressure inside the chamber reaches a certain pre-determined value,
- optionally, means configured to break the jet of fluid so as to reduce the speed of the jet of fluid injected into the capsule and distribute the fluid across the bed of substance at a reduced speed.

Capsules of the prior art feature an injection wall or membrane (referred to as top membrane) which is to be pierced by a fluid injection element (e.g. needle) of a beverage preparation machine being part of a fluid system. When fluid is injected in the capsule compartment, a pressure is built up, which serves as an extraction means for extracting and/or dissolving ingredients contained inside the capsule, as described above. Such ingredients can be for instance a bed of roast and ground coffee "RG" as shown in FIG. 1.

In prior art capsules, when the injection needle is removed from the capsule injection wall, after the beverage has been prepared and dispensed, the capsule top membrane is pierced and a hole remains as illustrated in FIG. 1. However, the internal extraction fluid pressure "P" remains at least partly in the capsule compartment.

The consumer can stop the extraction at any given time and open the machine head, which will create a hole on top membrane while the capsule is still inside the machine. This results in product coming out of top hole (this phenomenon is referred to as "backflow") and causing machine cleanliness issue. Our tests showed that even 0.05 bar is enough to create product back-flow from the top hole on the capsule.

In some exceptional cases, the backflow is very important due to a very high residual internal pressure within the capsule so that a jet of liquid splashes out of the capsule, which is named "whale effect". Such a "whale effect" is represented as an upwardly-directed jet in FIG. 1. Although such a phenomenon occurs randomly and infrequently, it is undesirable because hot liquid splashing out is messy. Moreover, in case the liquid is water mixed with an ingredient, such a leakage of liquid from the capsule top membrane is also undesirable for a cleanliness point of view, which forces the consumer to spend time cleaning the machine and its surroundings after usage.

A solution was developed in current machines to prevent early opening of the machine brewing head, particularly until the capsule internal fluid pressure is sufficiently low. This solution is a five second light blinking on the machine to show consumer not to open the machine head until the blinking stops. However, this solution does not work during extraction of recipes for which more than 5 seconds is necessary to release the pressure inside the capsule after the fluid injection has been stopped inside the capsule.

It is therefore an objective of the present invention to provide a beverage preparation system and capsule that prevents the so-called "backflow" or "whale effect" phenomenon described above, whatever the beverage preparation conditions or ingredient properties.

SUMMARY OF THE INVENTION

The main objective set out above is met with a capsule for use in a beverage preparation machine, said capsule comprising side, bottom and top walls defining a closed chamber, said chamber containing an ingredient to be dissolved and/or extracted by a fluid injected under pressure within said capsule, said fluid being provided through an injection element of the machine that is able to pierce an injection wall of the chamber, said capsule further comprising a beverage dispensing wall able to open for releasing a beverage prepared from said ingredient and said fluid, said capsule comprising a separating wall within the chamber that separates, in a leak-tight manner:

an ingredient-containing compartment, and a fluid injection compartment, said separating wall comprising a one-way valve able to let fluid under pressure flow only from the injection compartment towards the ingredient-containing compartment, said valve being actuated in its open configuration by the injection element of the machine.

The capsule according to the present invention is characterized in that the one-way valve is either:

(i) a spring-mounted ball valve, or alternatively (ii) a flexible resilient O-ring valve mounted in a circular channel of the separating wall.

In the case said one-way valve if the ball-valve type, it is preferably able to circulate fluid under pressure within the ingredient-containing compartment, in the form of a jet.

Preferably, the fluid injection wall is the top wall, and said beverage dispensing wall is the bottom wall.

In all cases, the fluid is advantageously injected by the machine with said capsule at a pressure comprised between 0.1 and 20 bar, preferably between 1 and 15 bar, more preferably between 2 and 12 bar.

The fluid injection element of the machine can comprise at least one fluid-injection needle.

In a preferred embodiment of the invention, the beverage dispensing wall comprises:

opening means to open said wall when fluid pressure inside said chamber increases above a first predetermined level, and reclosing means to close the capsule, after said beverage has been dispensed from said chamber and the fluid pressure within said chamber has decreased below a second predetermined level.

The ingredient for use in a capsule according to the invention can be roast and ground coffee, and/or can be chosen within the list of water-soluble ingredients such as: coffee, tea, cocoa, milk, soup, fruit juice, vegetable juice, soda mix, or infant nutrition products, in powder, gel, compacted powder, or liquid concentrate form, or a combination thereof.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1:
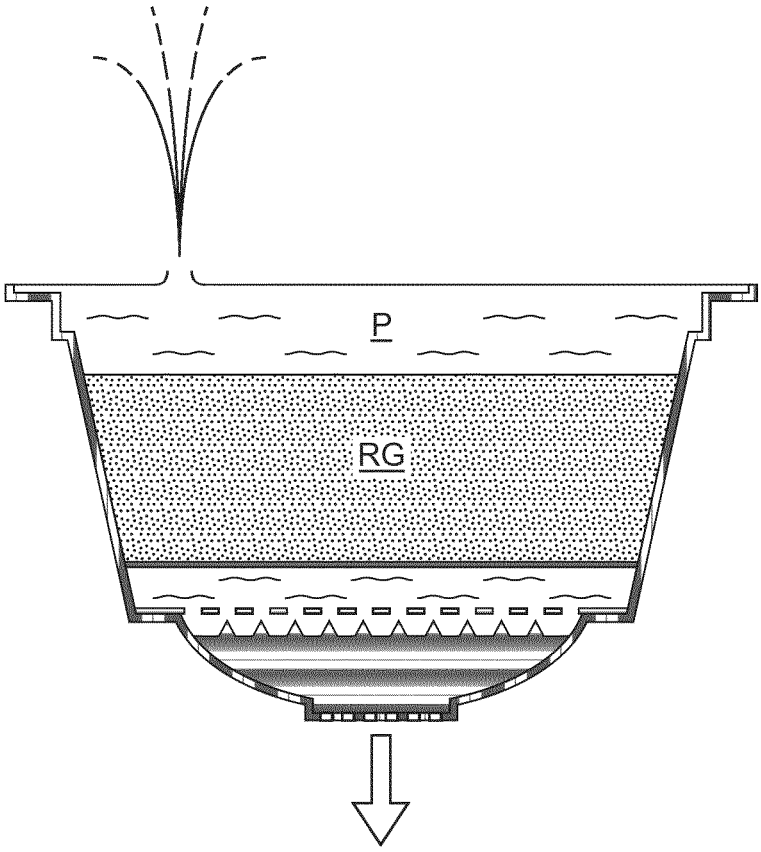
FIG. 1 is a schematic view of a prior art capsule wherein "whale effect" fluid resurgence has occurred.
Figure 2:
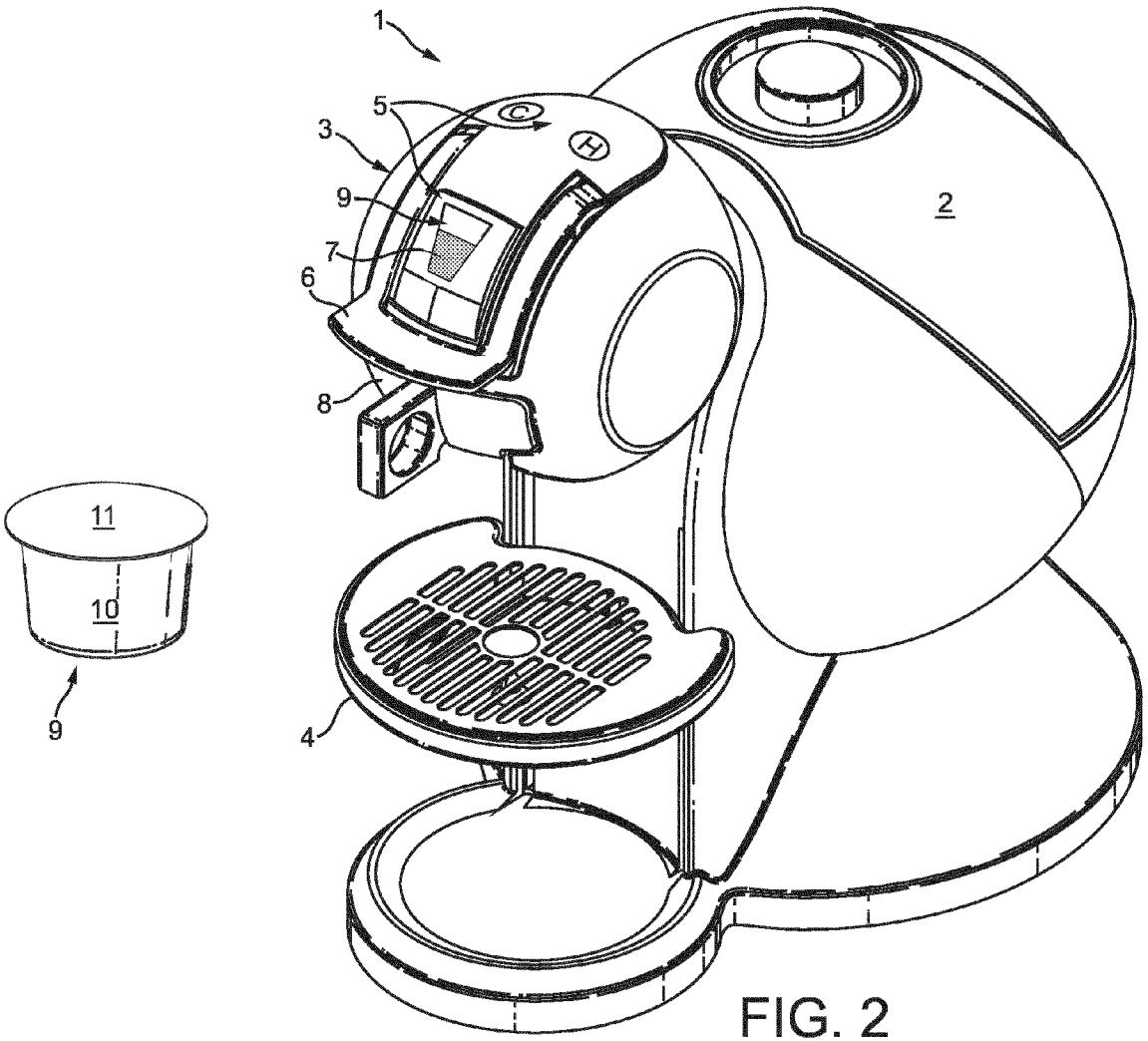
FIG. 2 is a schematic perspective view of a beverage preparation machine suitable for use with a capsule according to the present invention.

The capsule according to the present invention is for use in a beverage preparation machine as illustrated in FIG. 2.

Such a beverage preparation machine comprises a base having a reservoir 2, a brewing head 3, a cup tray 4 for holding a cup below the brewing head 3 and wherein the prepared beverage flows. The beverage preparation machine further comprises a control panel 5 for setting working parameters of the machine (e.g. volume of beverage to be dispensed, pressure of the fluid to be injected inside the capsule, temperature of the beverage, etc.).

The beverage preparation machine further comprises a handle 6 for opening and closing the brewing head, respectively in configurations for receiving a capsule and for preparing a beverage (closed brewing head in functional configuration). It also comprises a display 7 for displaying information to the user about the machine settings, progression of the beverage preparation, etc. Also, the machine 1 comprises a capsule holder 8 for holding a capsule 9. Said capsule holder is adapted to be removably introduced in a specific recess of the brewing head 3. In FIG. 2, the capsule holder is shown in place within the brewing head.

A capsule 9 for use in the beverage preparation machine 1 is also illustrated in FIG. 2. It comprises a body with side walls 10, and a top membrane 11. The capsule side walls 10 are rigid or semi-rigid thermoplastic material, and the top membrane 11 is made of a monolayer or multilayer thermoplastic material that is sufficiently thin to be pierceable by a fluid injection needle located in the brewing head of the machine 1.

Figure 3:
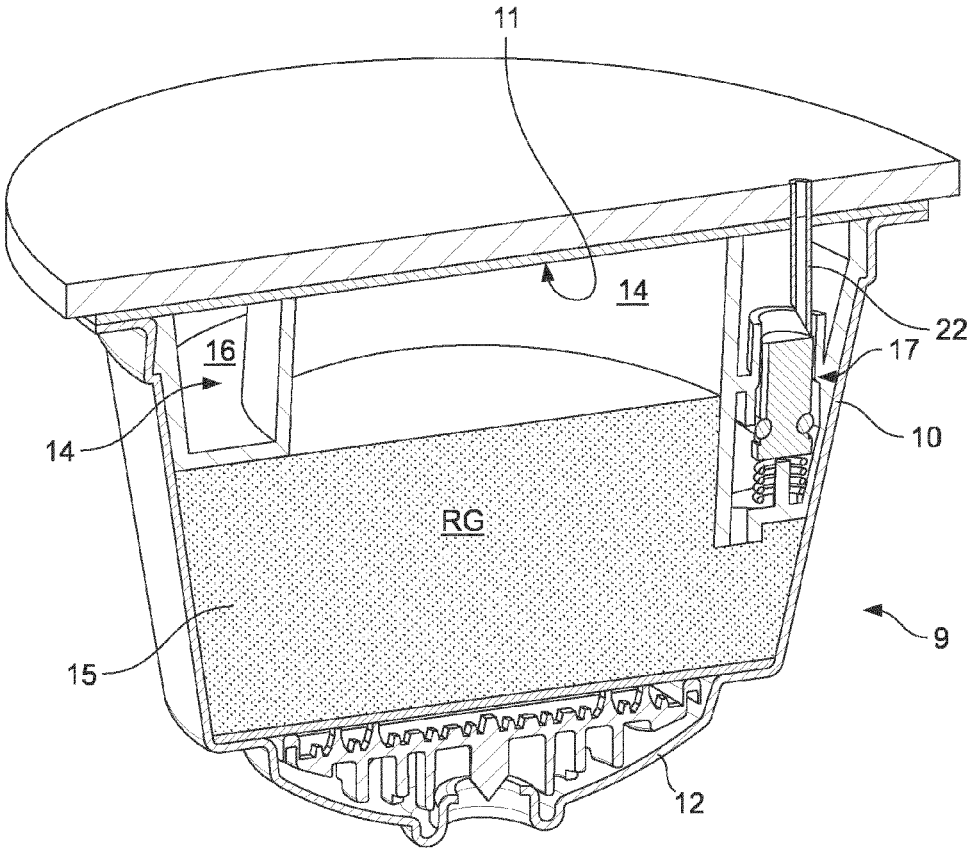
FIG. 3 is a cut perspective view of a first embodiment of the capsule according to the invention.
Figure 4:
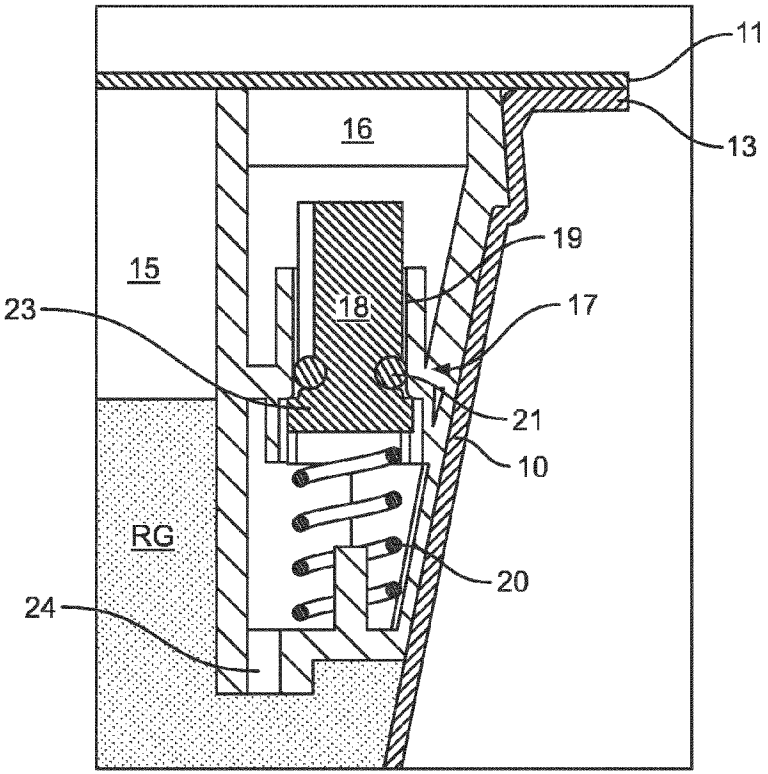
FIG. 4 is an enlarged cut view of a capsule similar to that of FIG. 3, wherein the valve is in the open configuration.

A capsule according to the invention is represented in detail in FIGS. 3 and 4. The capsule bottom wall 12 and side walls 10 are made as one integral part. The capsule further comprises a top membrane 11, which is to be sealed on a top peripheral edge 13 of the capsule side walls 10.

According to the invention, a separating wall 14 is disposed within the capsule internal chamber.

The wall 14 separates, in a leak-tight manner:

an ingredient-containing compartment 15, and a fluid injection compartment 16.

The separating wall 14 comprises a one-way valve 17 able to let fluid under pressure flow only from the injection compartment towards the ingredient-containing compartment.

Figure 5:
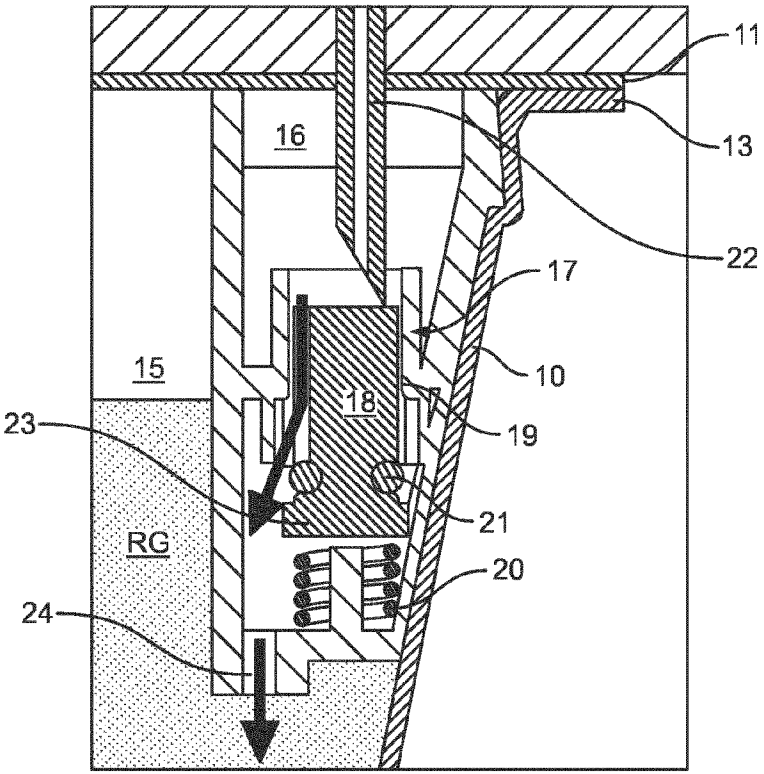
FIG. 5 is an enlarged cut view of a capsule similar to that of FIG. 3, wherein the valve is in the closed configuration.

In a first embodiment of the invention illustrated in FIGS. 3, 4 and in FIG. 5, the one-way valve is a spring-mounted ball valve 17. The term "ball valve" is used in the present specification as a generic term that encompasses all variants based on the same principle as ball valves. As it can be seen in FIGS. 3, 4 and 5 in particular, the ball can be replaced by another type of movable valve member 18 having the same function as a ball, but having a different shape. Precisely, in the drawing, the valve member which is movable in translation is a cylinder 18 that can slide inside a fluid conducting channel 19 of the valve.

The movable valve cylinder 18 is mounted on a spring 20, such that when the valve is in its default closed configuration as illustrated in FIG. 4, the valve is closed. As shown in FIG. 4, the cylinder comprises an O-ring 21 that ensures a leaktightness when the valve is closed. Such a valve is dimensioned an structured to guarantee a leaktightness even when the fluid pressure ahead of the valve reaches up to 12 bar.

According to the invention, the valve 17 is open by engagement of the movable valve member 18 with the fluid injection needle 22, as illustrated in FIG. 5. When the capsule 9 is functionally inserted inside the corresponding location of the beverage preparation machine, the tip of the fluid injection needle 22 of the machine presses against the top end of the movable valve member 18, and moves the latter against the return force of the spring 20, so that the closing portion 23 of the cylinder 18—as well as the O-ring 21—escape the edge of the fluid conducting channel 19 of the valve. This opens a fluid communication between the fluid injection compartment 16 and the ingredient compartment 15 of the capsule, thereby allowing fluid under pressure to flow from one to the other compartment, as illustrated by arrows in FIG. 5. In that case, the flow of fluid traverses a flow directing channel 24 that creates a powerful jet of fluid through the ingredient RG inside the compartment 15. The spring 20 can be made of any suitable material and have any suitable shape. For instance it can be a plastic or metal coiled spring, or a plastic tongue spring for instance. In any case, the functional principle of the spring remains. When the machine is open and the needle is moved from the capsule, the moved cylinder 18 returns back into its initial position by effect of the spring 20, hence closing the valve and stopping the flow of fluid between the two capsule compartments. In that case, even if fluid pressure remains in the ingredient compartment, no fluid will pass upwardly to the fluid injection compartment, therefore preventing any backflow of product through the hole pierced in the top membrane by the injection needle.

In this first embodiment, a proper orientation of the capsule inside the machine is required to ensure that the fluid-injection needle of the machine is aligned with the position of the capsule valve member 18.

Figure 6:
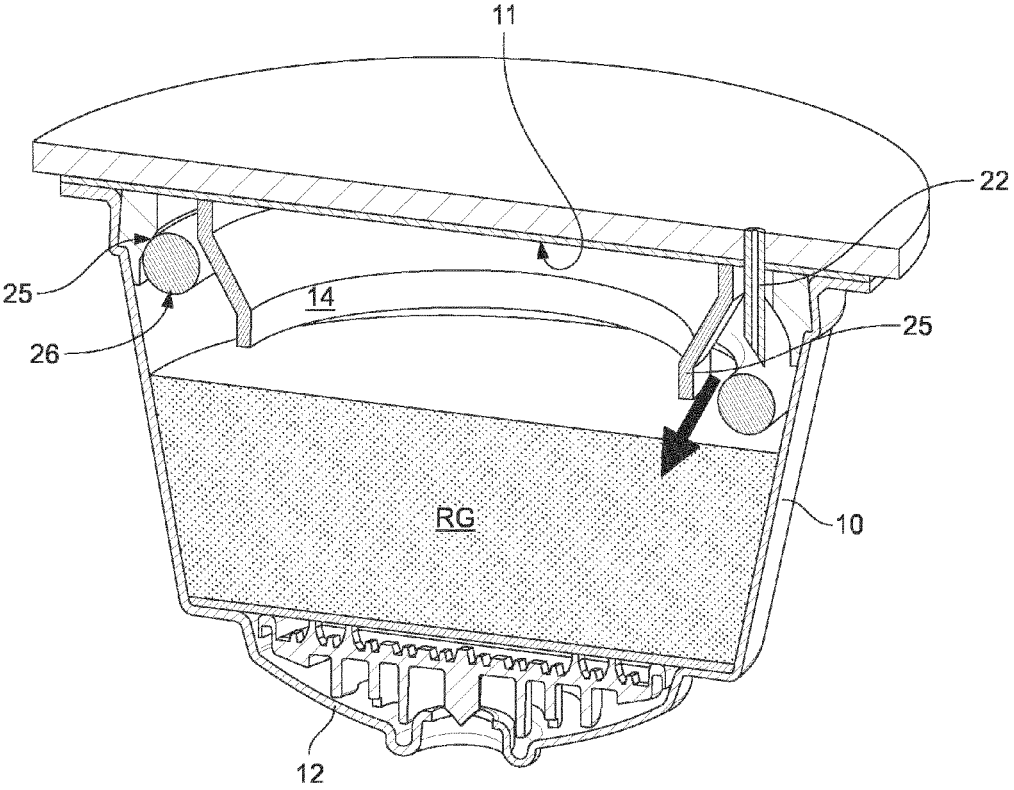
FIG. 6 is a cut perspective view of a second embodiment of a capsule according to the invention.

In a second embodiment of the invention illustrated in FIG. 6, the separating wall 14 comprises a peripheral circular, or semi-circular, channel 25, which fluidly connects the fluid injection compartment 16 and the ingredient compartment 15. The spring-mounted valve is replaced by a deformable O-ring valve 26 that normally closes the channel 25, as illustrated on the left hand side of the FIG. 6. The O-ring valve is held in place by hooks (not shown) which are built together with the separating wall 14. When the capsule is functionally located inside the machine, the tip of the injection needle 22 of the machine presses against one portion of the O-ring valve and flexes said portion downwards as shown on the right hand side of the FIG. 6, such that the channel 25 is open in the corresponding area of the flexed O-ring valve portion. In the open portion, fluid can flow from the fluid injection compartment 16, towards the ingredient compartment 15 as shown by an arrow in FIG. 6. When the machine is open and the needle is moved from the capsule, the flexed portion of the O-ring valve returns back into its initial position, hence closing the valve.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A capsule for use in a beverage preparation machine, the capsule comprising:

side, bottom and top walls defining a closed chamber, the chamber containing an ingredient to be dissolved and/or extracted by a fluid injected under pressure within the capsule, the fluid being provided through an injection element of the machine that is able to pierce an injection wall of the chamber, the injection wall being the top wall and comprising a membrane sealed on a top peripheral edge of the capsule side walls;

a beverage dispensing wall able to open for releasing a beverage prepared from the ingredient and the fluid; and a separating wall within the chamber that separates, in a leak-tight manner, an ingredient-containing compartment and a fluid injection compartment, wherein the fluid injection compartment comprises a one-way valve that fluidly connects the ingredient containing compartment and the fluid injection compartment wherein the one-way valve is able to let fluid under pressure flow only from the injection compartment towards the ingredient-containing compartment, the one-way valve being actuated in its open configuration by the injection element of the machine, and the one-way valve being a flexible resilient O-ring valve mounted in a peripheral circular or semi-circular channel of the separating wall.

2. A capsule according to claim 1, wherein the beverage dispensing wall is the bottom wall.

3. A capsule according to claim 1, wherein the ingredient is selected from the group consisting of roast and ground coffee, water-soluble ingredients, a powder, a gel, a compacted powder, a liquid concentrate form, and a combination thereof.

* * * * *